US007613407B2

(12) United States Patent
Craig et al.

(10) Patent No.: US 7,613,407 B2
(45) Date of Patent: Nov. 3, 2009

(54) METHOD AND APPARATUS TO DETECT LOADS ASSOCIATED WITH ONE OF A PLURALITY OF COMPONENTS DRIVEN BY A SHARED MOTOR IN AN IMAGE FORMING APPARATUS

(75) Inventors: Michael William Craig, Frankfort, KY (US); Steven Michael Turney, Lexington, KY (US); Danny Keith Chapman, Sadieville, KY (US)

(73) Assignee: Lexmark International, Inc.

( * ) Notice: Subject to any disclaimer, the term of this patent is extended or adjusted under 35 U.S.C. 154(b) by 494 days.

(21) Appl. No.: 11/383,266

(22) Filed: May 15, 2006

(65) Prior Publication Data

US 2007/0264036 A1 Nov. 15, 2007

(51) Int. Cl.
*G03G 21/12* (2006.01)

(52) U.S. Cl. ..... 399/35; 399/36; 399/37; 399/358; 399/360

(58) Field of Classification Search ..... 399/35–37, 399/358, 360
See application file for complete search history.

(56) References Cited

U.S. PATENT DOCUMENTS 4,314,242 A * 2/1982 Kuru et al. ..... 399/61
6,873,819 B2 * 3/2005 Ahn et al. ..... 399/360
6,889,013 B2 * 5/2005 Chapman et al. ..... 399/13
7,245,103 B2 * 7/2007 Chapman et al. ..... 318/651
7,383,014 B2 * 6/2008 Baker et al. ..... 399/358
2005/0047807 A1 * 3/2005 Cook et al. ..... 399/35
2005/0163545 A1 * 7/2005 Cook et al. ..... 399/358
2006/0250104 A1 * 11/2006 Reichert et al. ..... 318/651

* cited by examiner

*Primary Examiner*—David M Gray
*Assistant Examiner*—Ryan D Walsh
(74) *Attorney, Agent, or Firm*—Coats & Bennett

(57) ABSTRACT

An image forming apparatus includes a waste toner system that collects waste toner in a waste toner container. An amount of waste toner collected in the container is increased by using a driven toner distributing member that distributes accumulated toner within the container. The toner distributing member may be driven by a shared speed-controlled motor that further drives an image forming process member. The waste toner system may detect the accumulation of waste toner by monitoring a drive control circuit while the toner distributing member is being driven. For example, a logic circuit may detect the accumulation of waste toner based on monitoring a predetermined frequency of interest of a frequency domain transform of a motor control signal, the frequency of interest associated with the shared motor driving the toner distributing member.

37 Claims, 9 Drawing Sheets

METHOD AND APPARATUS TO DETECT LOADS ASSOCIATED WITH ONE OF A PLURALITY OF COMPONENTS DRIVEN BY A SHARED MOTOR IN AN IMAGE FORMING APPARATUS

An image forming apparatus, such as electrophotographic (EP) printers or copiers, typically uses a particulate developer material (toner) in their imaging operations. Such machines form output images by depositing toner onto a charged roller or other photosensitive member according to a latent print image and then transferring that toner to a media sheet. Some amount of residual toner remains on the photosensitive member after image transfer and requires removal, such as by bringing a cleaning blade or other scraping mechanism into contact with the photosensitive member. The waste toner thus removed oftentimes is collected within a container included in the image forming apparatus. Potentially significant amounts of waste toner may be collected over time, particularly in machines that include multiple process cartridges, each of which acts as a source of waste toner. The waste toner may be collected and deposited into a waste toner box. Generally, it is useful to determine when a waste toner box becomes full because toner overflow may back up into the waste removal system and contaminate or damage components. Sensors, including optical or mechanical types, are used in some systems to detect a full waste toner box. However sensor solutions often require an increased number of parts and increased cost. Another solution detects variations in drive signals that move an agitator within the waste toner box. For example, the motive power needed to drive such an agitator may increase with increasing levels of waste toner in a waste toner box.

Unfortunately, motors that drive these types of agitators may drive multiple systems in an image forming apparatus. For example, a single motor may drive toner supply cartridges, fusers, augers, belts, or other rotating components. Further, each of these components may be geared down at different ratios, such as for example 20:1 or 10:1. Those components that are geared down by larger ratios impose a smaller load on the motor. The waste toner box agitator may be geared down by a relatively large amount, which makes it difficult to identify increased motor loads. That is, relative to other components that are driven by the same motor, an increase in the load required to drive the waste toner agitator may be insignificantly perceptible. Therefore, it may be difficult to identify increased loads placed on a motor caused by a waste toner agitator.

SUMMARY

Exemplary embodiments disclosed herein relate to an image forming apparatus that includes a waste toner system to collect waste toner in a waste toner container. An amount of waste toner collected in the container is increased by using a driven toner distributing member that distributes accumulated toner within the container. The toner distributing member may be driven by a shared speed-controlled motor that further drives an image forming process member. The toner distributing member and the image forming process member may be driven at different gear ratios which means each may impart different magnitudes of loads on the shared motor.

The waste toner system may detect the accumulation of waste toner by monitoring a drive control circuit while the toner distributing member is being driven. For example, a logic circuit may detect the accumulation of waste toner based on monitoring a predetermined frequency of interest of a motor control signal. In one embodiment, the logic circuit monitors a frequency domain transform of the motor control signal. The frequency of interest may be associated with the shared motor driving the toner distributing member. For instance, the frequency of interest may be based upon the gear ratio between the toner distributing member and the shared member.

DETAILED DESCRIPTION

Figure 1:
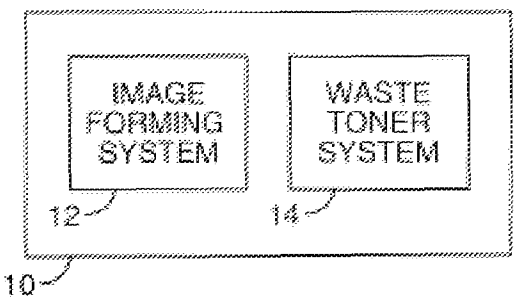
FIG. 1 is a diagram of an exemplary image forming apparatus according to one or more embodiments.

FIG. 1 presents a much-simplified illustration of an image forming apparatus 10 as comprising an image forming system 12 and a waste toner system 14. Of course, the two systems as a matter of practical implementation may not actually be implemented in such cleanly separated fashion in an actual image forming apparatus 10. Thus, it should be understood that FIG. 1 provides a basis for beginning a discussion of exemplary details rather than as a literal depiction of any electromechanical and electro-optical systems within image forming apparatus 10. One may refer to the "C520" series color electrophotographic (EP) printer manufactured by Lexmark International, Inc., for an example of image forming apparatus details.

Regardless of its specific implementation details, image forming apparatus 10 uses a consumable developer material, such as particulate toner, to form desired images on media sheets processed by it. Thus, image forming apparatus 10 may be a "laser" printer, copier, fascimile, etc. During imaging operations, the image forming apparatus 10 forms desired images, e.g., text, graphics, etc., by transferring developer from one or more image transfer members, such as rotating photoconductive drums, to copy sheets or other media being fed through the image forming apparatus 10. Residual developer material is cleaned from the image transfer members after image forming operations to maintain the requisite print quality. This residual developer material, which broadly is referred to as "waste toner" herein, is collected within image forming apparatus 10 in a controlled fashion.

For purposes of this discussion, the image forming details are not important to understanding the embodiments disclosed herein. Rather, the focus properly is on the waste toner system 14 in terms of its operation vis-á-vis the waste toner being accumulated in the image forming apparatus 10. In selected embodiments, the discussion further focuses on the cooperative sharing of elements between the image forming system 12 and the waste toner system 14.

Figure 2:
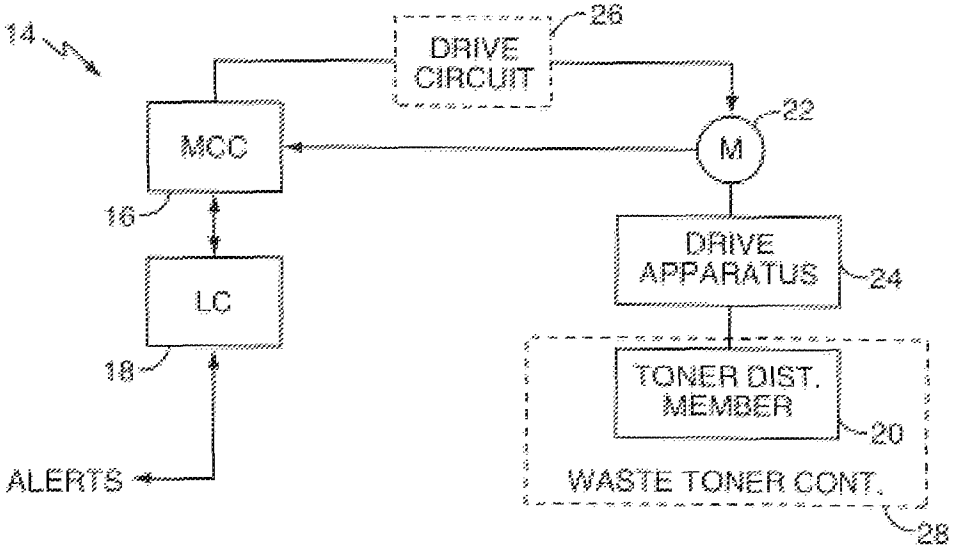
FIG. 2 is a diagram of an exemplary waste toner system according to one embodiment.
Figure 4:
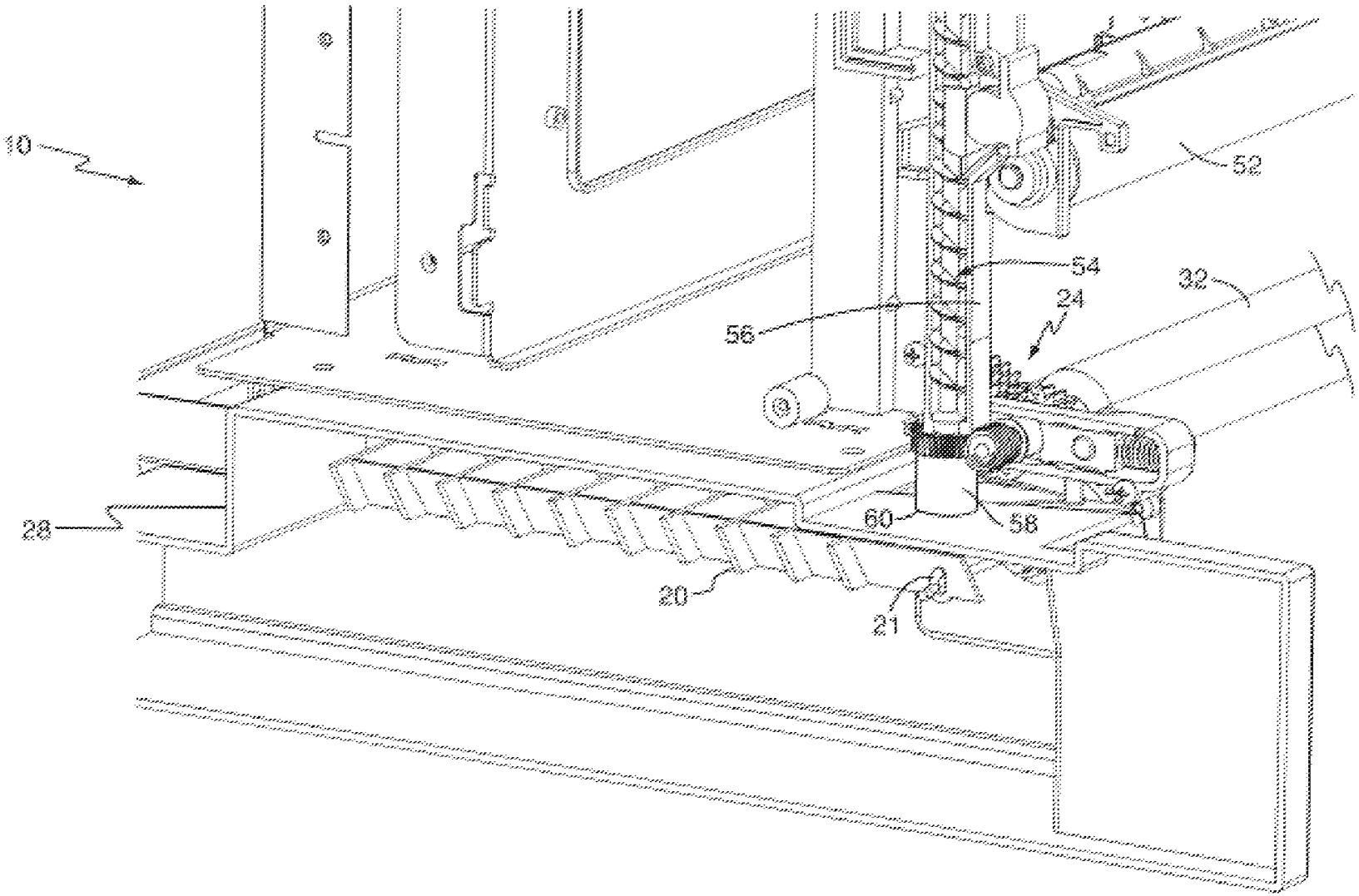
FIG. 4 is a diagram of selected elements of an exemplary waste toner system shown in perspective view within an exemplary image forming apparatus.
Figure 6:
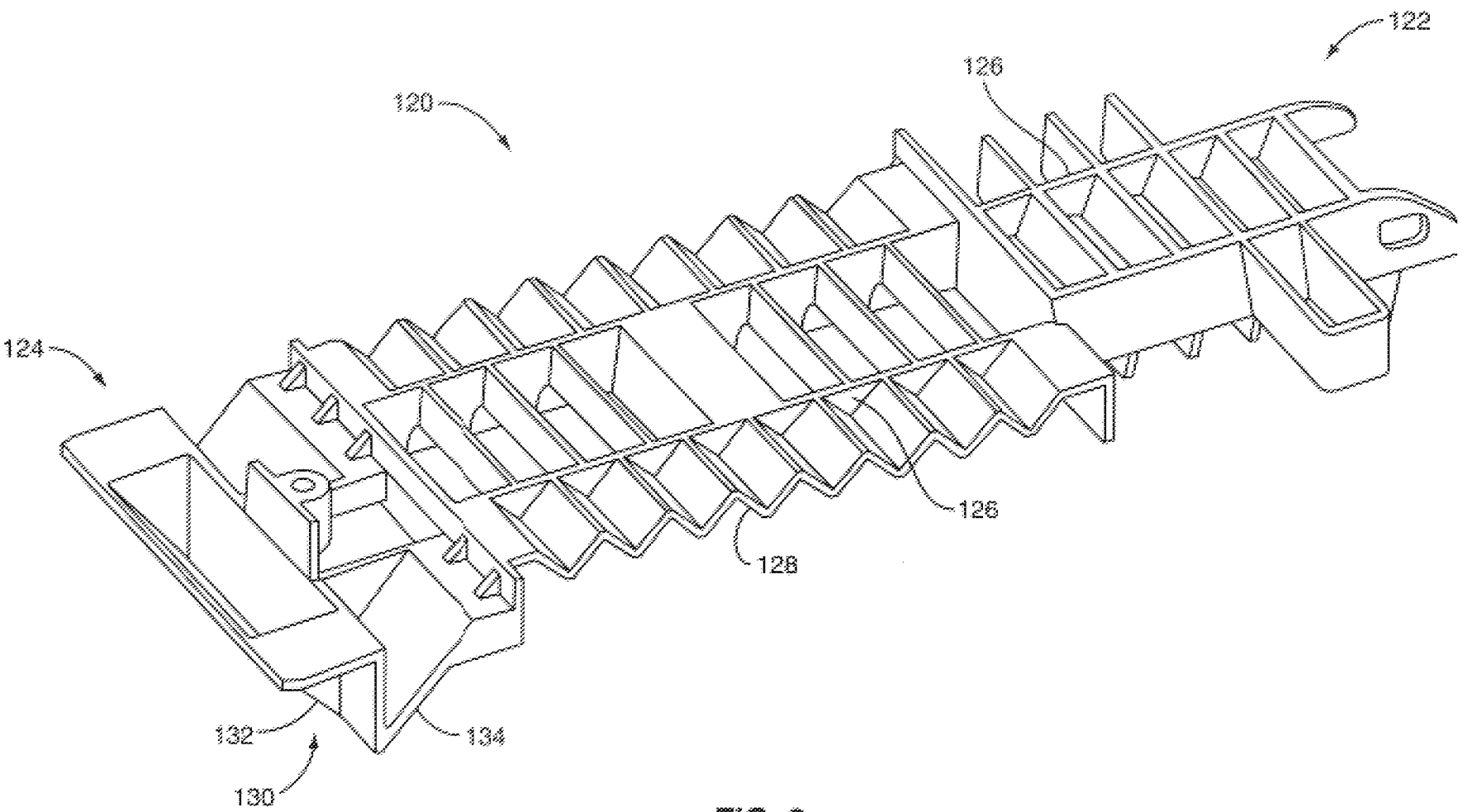
FIG. 6 is a perspective view of one embodiment of a toner distributing member.
Figure 7:
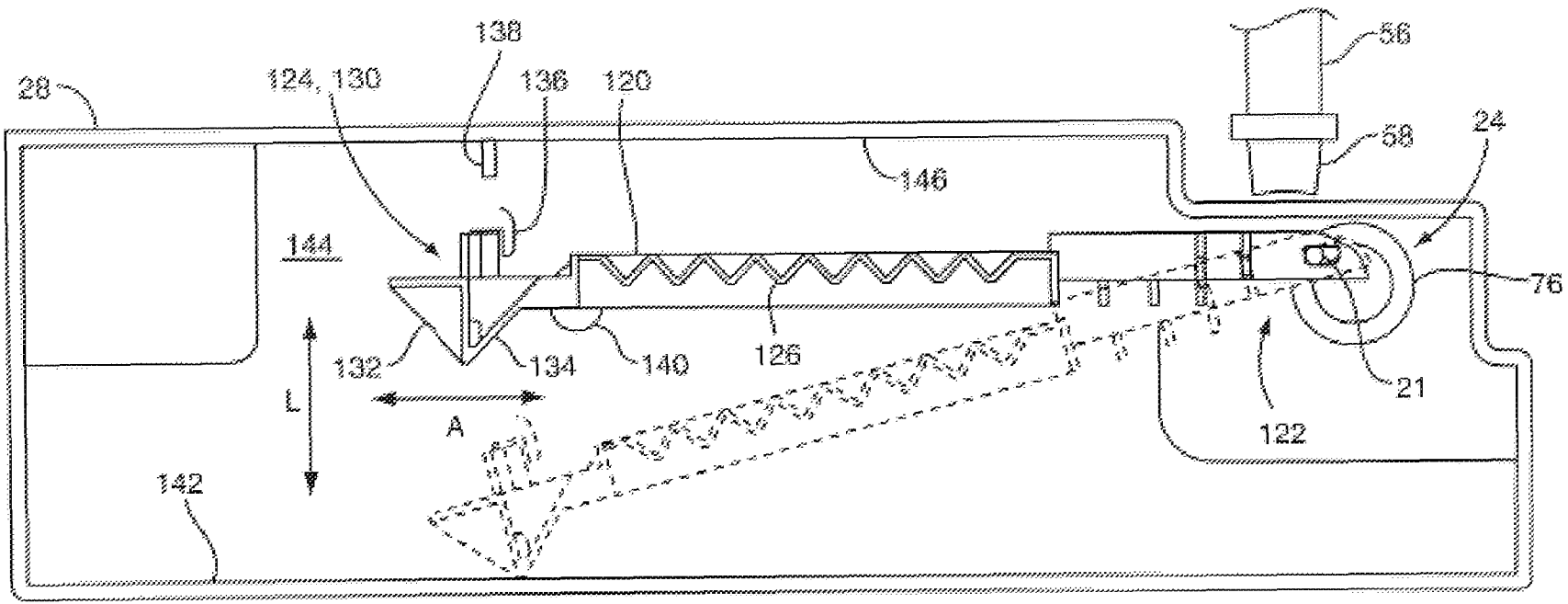
FIG. 7 is a side view of selected elements of an exemplary waste toner system within an exemplary image forming apparatus.

FIG. 2 illustrates an exemplary waste toner system 14 comprising a motor control circuit (MCC) 16 and a logic circuit (LC) 18, and that further includes, or at least is associated with, a toner distributing member (TDM) 20, a motor (M) 22, a drive apparatus 24, and a motor drive circuit 26. As illustrated, the TDM 20 is moveably positioned within a waste toner container 28 although other arrangements are contemplated. Exemplary toner distributing members 20, 120 are illustrated in FIGS. 4, 6, and 7 and described in greater detail below. Additional descriptions of a TDM 20, 120 and the control systems adapted to operate and analyze the motion of the TDM 20, 120 are disclosed in commonly assigned, co-pending U.S. patent application Ser. No. 10/647,420, filed Aug. 25, 2003 and U.S. patent application Ser. No. 11/084,980, filed Mar. 21, 2005, each of which is hereby incorporated by reference herein.

In operation, waste toner produced from ongoing imaging operations of the image forming apparatus 10 is conveyed to and collected in waste toner container 28. Thus, waste toner accumulates in container 28 and at some point container 28 must be removed and emptied or replaced. As this represents an ongoing point of service, it is desirable to accumulate as much waste toner as possible in container 28 before requiring its removal. In other words, it is desirable to fully use the volumetric capacity of container 28 for the collection of waste toner.

Although it may be difficult to achieve a 100% packing efficiency, TDM 20 greatly aids in the efficient use of the interior volume of container 28 by "spreading" or otherwise distributing accumulated toner within the interior of container 28. Motor 22 drives TDM 20 via drive apparatus 24 such that the TDM 20 oscillates, vibrates, rotates, reciprocates, or otherwise moves within container 28 to accomplish the desired spreading of accumulated waste toner therein.

Even aided by the spreading operations of TDM 20, container 28 eventually reaches a "full" condition after which no additional waste toner should be collected in it. Indeed, one or more exemplary embodiments prohibit additional image forming operations until the full condition, once detected, is relieved. Such prohibition avoids overfilling the waste container and reduces the possibility of contaminating the interior of the image forming apparatus 10 with waste water overflow.

An exemplary embodiment of the waste toner system 14 detects the full condition of container 28 based on monitoring MCC 16 while motor 22 is driving the TDM 20. Waste toner system 14 also may detect a "near full" condition of container 28 to gain the valuable benefit of alerting users of the image forming apparatus 10 that container 28 is nearing its capacity limit. Both conditions may be detected, for example, by monitoring one or more control signals of MCC 16 while it is controlling motor 22 during toner distributing operations. It should be noted that such monitoring may be based on analog or digital signals and that the present invention contemplates a variety of monitoring schemes.

Figure 3:
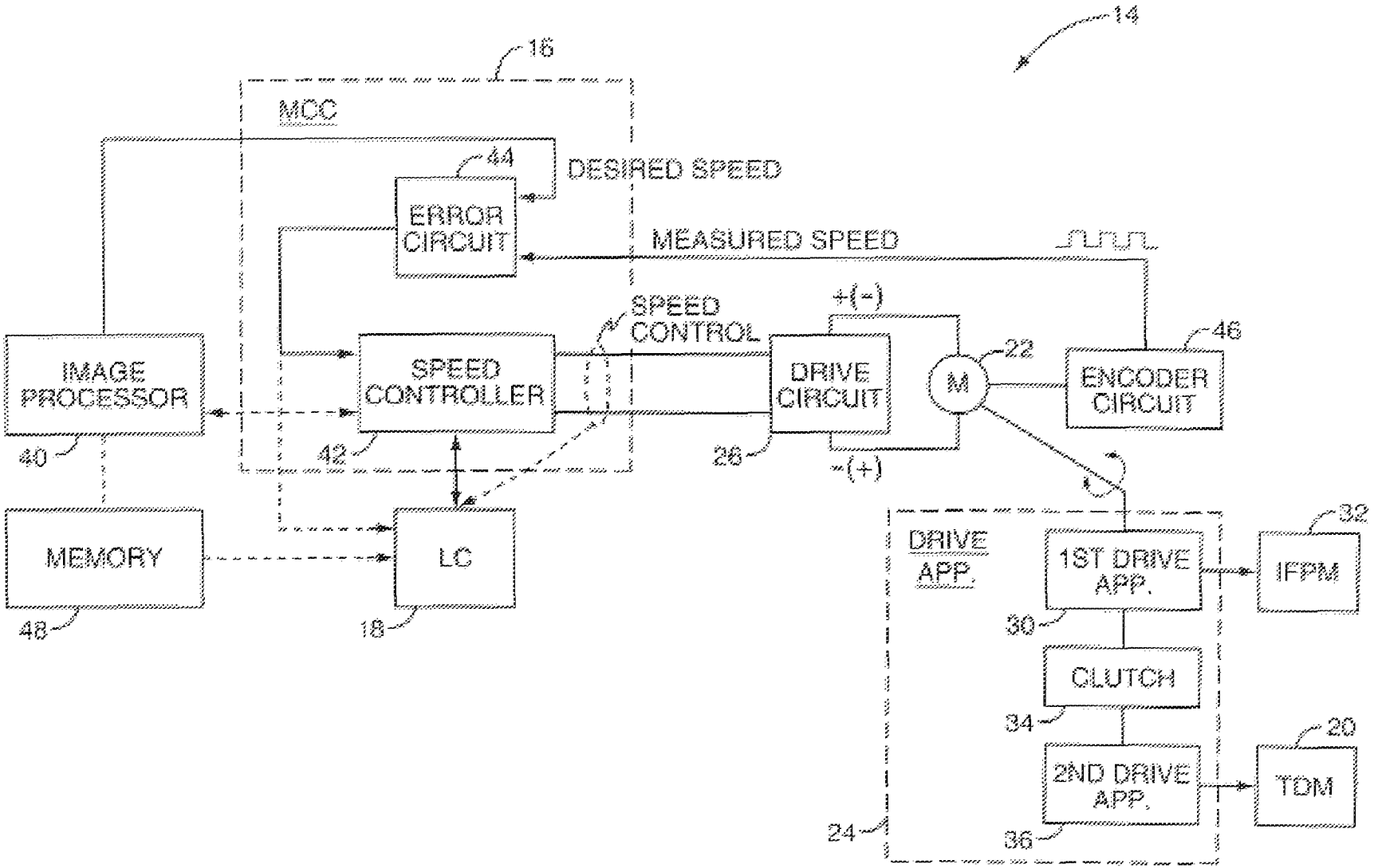
FIG. 3 is a diagram of an exemplary waste tner system according to one embodiment.

FIG. 3 illustrates another exemplary waste toner system 14, wherein motor 22 comprises a shared motor used in image forming operations as well as in toner spreading operations. FIG. 3 further illustrates an image processor 40, a speed controller 42 and error circuit 44 within MCC 16, an encoder circuit 46, and one or more storage elements (e.g., memory device(s)) 48. An exemplary drive apparatus 24 drives an image forming process member (IFPM) 32 and TDM 20, and includes a first drive apparatus 30 to drive IFPM 32, and further includes a selective engagement device (e.g., one-way clutch) 34 to selectively drive a second drive apparatus 36 that is coupled to TDM 20. Note that in some embodiments, IFPM 32 may function as an element of drive apparatus 30 such that clutch 34 is driven by the rotation of IFPM 32, for example. The IFPM 32 may comprise a variety of rotatable members, including for example, a registration roller, a bump-align roller, a developer roller, a photoconductive member, a transfer roller, a fuser roller, or other transport roller. In one embodiment, the first drive apparatus 30 may include a first gear train representing a first gear reduction. Further, the second drive apparatus 36 may include a second gear train representing a second, additional gear reduction. Thus, the first gear ratio between the IFPM 32 and the motor 22 may be smaller than the second gear ratio between the TDM 20 and the motor 22. One alternate embodiment of the drive apparatus 24 foregoes the clutch 34 and therefore, the second drive apparatus 36 and TDM 20 are driven whenever the IFPM is 32 is driven.

In exemplary operation, MCC 16 controls the direction and speed of motor 22 based on an output speed control signal generated by the MCC 16. In an exemplary embodiment, speed controller 42 comprises a Pulse Width Modulation (PWM) controller that generates an output pair of PWM signals wherein, as is well understood in the art, the relative pulse polarities control the direction of motor 22 and the pulse widths control the speed of motor 22.

As motor 22 turns, encoder circuit 46 generates a feedback signal that indicates motor speed. The signal may be a proportional analog signal or may be a digital signal. For example, encoder circuit 46 may comprise a photo-interrupter based encoder circuit that generates output pulses at a frequency related to the motor's rotational speed. The motor 22 may also include an internal frequency generator that produces feedback signals of this type. Error circuit 44 of MCC 16 receives the speed feedback signal as one input and receives a reference (desired speed) signal as a second input. The error signal output by error circuit 44 indicates error between actual and desired motor speed, and thus serves as a control input to speed controller 42. In one embodiment, the error circuit 44 comprises a proportional integral (PI) or proportional integral derivative (PID) controller. Further, the error circuit 44 may monitor one or both of the speed and position of the motor 22 to implement the desired motion control. An exemplary error circuit 44 is disclosed in commonly assigned, co-pending U.S. patent application Ser. No. 10/378,430, filed Mar. 3, 2003, which is hereby incorporated by reference herein. MCC 16 thus functions as a feedback control circuit configured to vary its output speed control signal as needed to maintain a desired motor speed over a range of motor loads.

In a PWM-based embodiment, speed controller 42 may comprise an n-bit PWM generator that controls motor speed by varying the duty cycle of its output PWM from about 0% to about 100% as needed to maintain the desired motor speed. N-bit PWM control provides $2^n-1$ pulse width adjustment resolution, so an exemplary 16-bit PWM controller offers a numerical control range from 0 to 65,535. With this approach, speed controller 42 may be loaded with a PWM value corresponding to a desired motor speed and, in operation, adjust that value up or down as needed based on the error signal from error circuit 44. Thus, the speed control signal monitored by logic circuit 18 may be the "live" PWM value of speed controller 42, which may be provided to logic circuit 18 as a digital value, or logic circuit 18 may monitor the output PWM signals.

An exemplary drive circuit 26 may be implemented as an H-bridge motor drive circuit comprising a transistor-based push-pull arrangement that allows polarity reversal across motor 22 to enable operation in forward or reverse motor directions as desired. Those skilled in the art will appreciate that speed controller 42 may generate a speed control signal as a complementary pair of PWM waveforms to drive the H-bridge transistors. The natural impedance of motor 22, which may be a dc motor, acts as a low-pass filter to average the PWM pulses applied to the drive circuit 26 such that the average drive voltage across the motor is a function of the modulated pulse width and frequency.

The logic circuit 18 may detect the accumulation of waste toner within container 28 by monitoring MCC 16 while the motor 22 is driving TDM 20. For example, until enough waste toner accumulates to begin interfering with movement of TDM 20, the MCC 16 should not have to substantially vary its speed control signal away from a nominal value to maintain the desired motor speed while driving TDM 20. Once waste toner accumulates in container 28 to the point where it begins interfering with the free movement of TDM 20, however, MCC 16 may have to adjust its speed control signal more substantially to maintain the desired motor speed.

Thus, in an exemplary embodiment, logic circuit 18 is programmed with, or has access to, one or more reference values, e.g., PWM value(s), corresponding to nominal waste toner accumulation conditions. In one embodiment, memory device 48 stores PWM reference values and may store other information, such as detection thresholds, etc. Reference values may be obtained, for example, by observing the speed control signal value needed to maintain a desired motor speed while driving TDM 20 with an empty container 28. By monitoring the PWM value(s) actually generated by MCC 16 while driving TDM 20, and comparing those monitored values to one or more reference values, logic circuit 18 may detect when (and to what extent) excess accumulated waste toner has begun interfering with the movement of TDM 20.

Logic circuit 18 may provide the desired speed information to MCC 16, or it may be provided by the image processor 40. Indeed, because logic circuit 18 may be implemented using a microprocessor configured to execute coded program instructions, logic circuit 18 may be incorporated into image processor 40. Of course, it should be understood that logic circuit 18 may be implemented as discrete logic, or as a stand-alone microprocessor or other programmable device, etc., and that, in general, it may be implemented in hardware, software, or some combination thereof. Similarly, MCC 16 may be implemented in hardware, software, or some combination thereof, and may be integrated with other functional elements or implemented as a stand alone circuit, as needed or desired.

The inclusion of logic circuit 18 within image processor 40, which may be referred to as a "Raster Imaging Processor" or RIP, is beneficial in that image processor 40 already includes the necessary logic to interact with and monitor MCC 16 because of its need to control motor 22 during imaging operations involving the IFPM 32. For example, image processor 40 may require that IFPM 32 be moved or rotated according to precise velocity profiles that ensure synchronization of IFPM 32 within the overall image forming process.

To better understand an exemplary embodiment of these detection operations, FIG. 4 provides a perspective view of selected details for image forming apparatus 10. An exemplary waste toner system 14 is configured to accumulate waste toner resulting from the imaging operations and includes motor 22 shared by the image forming and waste toner systems 12 and 14, respectively, waste toner container 28, toner distributing member 20, MCC 16, logic circuit 18, drive apparatus 24, and one or more waste toner transport members configured to receive waste toner from the image forming system 12 and transport the received waste toner to the waste toner container 28.

In the illustrated embodiment, the TDM 20 comprises a horizontally reciprocating toner rake 20 that is movably positioned at an upper elevation within container 28. A reciprocating arm 21 couples rake 20 to a drive gear (not shown here), which forms a part of drive apparatus 24.

The waste toner transport members include a vertical screw auger 54 enclosed within a vertical shaft (tube) 56. During imaging operations, residual toner is removed from one or more image transfer members 52. The waste toner is conveyed downward by screw auger 54. The terminal end 58 of shaft 56 is aligned with an inlet 60 formed as a topside opening into container 28. A seal may be used to close any gap between shaft 56 and inlet 60. Thus, collected waste toner flows downward through shaft 56, through inlet 60 and falls into container 28. Absent operation of the toner rake 20, the accumulated waste toner would tend to pile up in container 28 in the area below inlet 60.

In an exemplary embodiment, motor 22 is used to drive rake 20 at a desired motor speed. Within its control range, MCC 16 varies a speed control signal as needed to maintain motor 22 at the desired speed while driving rake 20. Therefore, logic circuit 18 may be configured to detect accumulation of waste toner by monitoring a motor control parameter such as the speed control signal or the error circuit signal, either of which changes in a characteristic fashion as excess accumulated waste toner begins interfering with movement of toner rake 20.

In addition to illustrating rake 20, FIG. 4 also illustrates at least a portion of its associated drive apparatus 24 and thus provides a basis for discussing exemplary drive apparatus details. More particularly, FIG. 3 illustrated the use of motor 22 as a shared motor for the dual benefit of speed-controlled motor operation during both image forming and toner spreading operations. The diagram also introduced additional drive apparatus details indicating that a first drive apparatus 30 may be used to drive IFPM 32 and that a second drive apparatus 36 may be used to drive the TDM 20.

In fact, whether or not motor 22 is speed-controlled, the schematic and diagrammatic representations of FIGS. 3 and 4 illustrate an exemplary drive apparatus 24 that allows essentially any type of motor to be shared by the image forming system 12 and the waste toner system 14. Specifically, clutch 34 may be used to engage the second drive apparatus 36 on a selective basis, such as a startup, or after printing, or as a function of the motor's direction of rotation.

Figure 5:
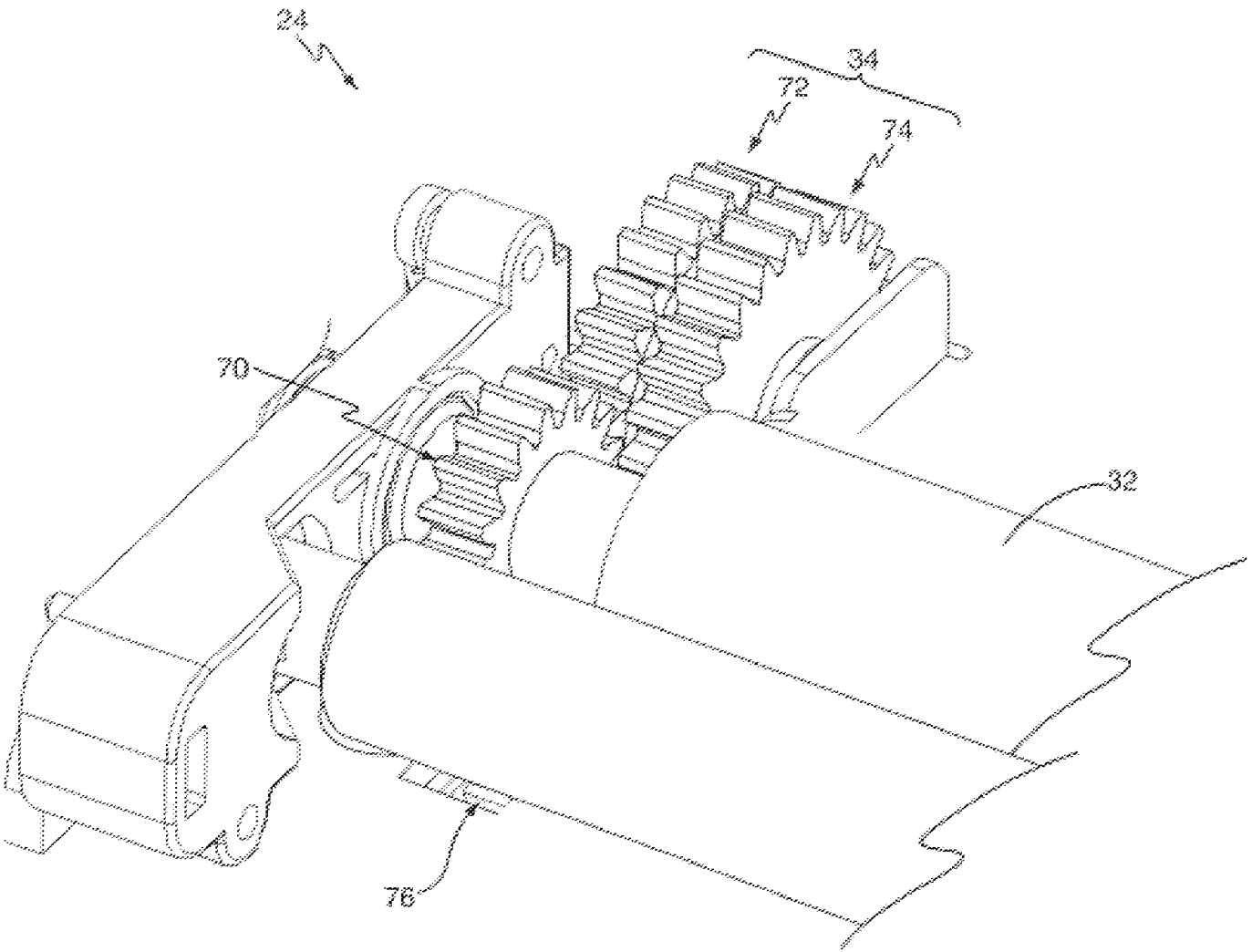
FIG. 5 is a diagram of selected elements of an exemplary drive apparatus shown in perspective view.

FIG. 5 illustrates the same end of IFPM 32 as shown in FIG. 4 but provides more details regarding an exemplary gear arrangement. IFPM 32 may be a media alignment roller, for example, that is used to feed media sheets into an image forming path (not shown) of the image forming system 12. As such, the roller is operated in a forward direction (relative to the feed direction of the media) to feed media sheets into the image forming system 12. When operating in the forward direction, it may be undesirable from a motor control perspective, to subject shared motor 22 to the additional (and potentially variable) load associated with driving the TDM 20.

In FIG. 5, one sees a drive pinion 70 attached at one end of IFPM 32; the motor 22 is not visible in FIG. 5, but is coupled to the other end. The pinion 70 engages a first gear 72 of clutch 34. Thus, rotation of IFMP 32 by motor 22 in either direction causes a counter rotation of gear 72. A second gear 74 is positioned adjacent to and on the same rotational axis of gear 72. The gears 72, 74 form components of the clutch 34, which is selectively engageable. The motion of gear 72 may be transmitted to rotate gear 74 through conventionally known electrical or mechanical clutches. In one embodiment, the clutch 34 may transmit rotational torque to gear 74 when the motor 22 rotates in one direction, but not when it rotates in the other direction. Regardless, gear 76 is coupled to rake drive arm 21 shown in FIG. 4 and, thus, the TDM 20 is driven in one motor direction but not the other. Of course, those skilled in the art immediately will appreciate that other selective engagement drive arrangements may be used as needed or desired.

A result of this exemplary configuration is that the gear 76 which rotates the drive arm 21 is geared down by an additional ratio that is determined by the respective ratios between gear pairs 70 and 72 as well as 74 and 76. Consequently, the motive torque supplied to the IFPM 32 may be greater than the motive power supplied to the TDM 20. This power reduction is a result of a larger gear ratio between the TDM 20 and motor 22 as compared to the gear ratio between the IFPM 32 and the motor 22. The corollary to this statement is that loads placed upon the motor 22 by the IFPM 32 may be significantly larger than loads placed upon the motor 22 by the TDM 20. As suggested above, a motor control parameter such as a motor drive voltage, an error value, a PWM duty cycle, or digitized values of either of these may be used to detect a full or near-full condition within the waste toner container 28. However, variations in the load imparted on the TDM 20 may be small as compared to the load variations imparted on the IFPM 32. As a result, it may be difficult for the MCC 16 and logic circuit 18 to parse out load variations caused by the TDM 20 that may be indicative of a full waste toner container 28. Accordingly, various features and processing steps may be implemented to generate, isolate, and identify load variations imparted on the motor 22 by the TDM 20.

FIG. 6 shows an isolated perspective view of an exemplary toner distributing member (TDM) 120 adapted for use in a waste toner container 28 (not shown in FIG. 6, but see FIGS. 4 and 7). In the present embodiment, the TDM 120 has a generally elongated shape extending between a supported end 122 and a free end 124. The TDM 120 may include one or more longitudinal spines 126 and raking surfaces 128 extending laterally from the spines 126. The spines 126 and raking surfaces 128 are advantageously oriented on the TDM 120 to distribute toner within the reservoir. In one embodiment, the raking surfaces 128 function to keep the member towards a surface of the toner. The TDM 120 of the present embodiment may also include a floating portion 130 having a plurality of floating surfaces 132, 134 oriented on the TDM 120 to cause the member to remain towards a surface of the toner within the reservoir. For instance, leading surface 132 may operate to lift the free end 124 of the TDM 120 during forward movements of the TDM 120. Conversely, trailing surface 134 may operate to lift the free end 124 of the TDM 120 during backward movements of the TDM 120. Various other features may also be incorporated on the TDM 120 to accommodate the shape of the interior of specific waste toner reservoirs.

Movement of the exemplary TDM 120 within a waste toner container 28 is shown more clearly in the schematic provided in FIG. 7. Selected components described above are repeated here for consistency. For example, the end 58 of waste toner transport shaft (tube) 56 is included as is the previously described gear 76 that is coupled to drive arm 21, which drives the TDM 120 in a reciprocating manner. The drive arm 21 is simultaneously coupled to the TDM 120 and the rotating gear 76. The drive arm 21 is disposed on the rotating gear 76 in an eccentric manner so that the supported end 122 of the TDM 120 traverses a circular path. This movement about the supported end 122, in turn, imparts a reciprocating, agitating motion at the free end 124 of the TDM 120. The direction of the agitating motion is indicated by the arrows labeled A in FIG. 7. With the TDM 120 moving in this reciprocating manner, the spines 126 and raking surfaces 128 may distribute accumulated toner from areas of heavy accumulation to areas of lighter accumulation within the waste toner container 28.

The supported end 122 of this embodiment of TDM 120 is pivotally coupled to the drive arm 21. This type of coupling permits the free end 124 of the TDM 120 to move not only in the agitating direction A, but also in a lifting direction L to advantageously accommodate an increasing quantity of waste toner within the container 28. In one embodiment (indicated by solid lines in FIG. 7), the free end 124 of TDM 120 is supported by a stop 140 that holds the free end 124 above the bottom surface 142 of the waste toner container 28. With the free end 124 supported in this manner, the TDM 120 may not physically contact waste toner until the toner has accumulated to the height of float feature 130. Leading 132 and trailing 134 surfaces of float feature 130 may advantageously keep the free end 124 towards the surface of the accumulated toner. Raking surfaces 126 may also remain out of contact with accumulating toner until the toner level within the container 28 reaches the height of the supported TMD 120. In this particular embodiment, the TDM 120 will ultimately lift off the stop 140 and the additional drag imparted on the TDM 120 by the toner may be sensed by the motor 22, motor drive circuit 26, motor control circuit 16, and logic circuit 18 shown in FIG. 3.

In another embodiment (indicated by dashed lines in FIG. 7), the free end 124 of TDM 120 may be allowed to fall toward a bottom surface 142 of the waste toner reservoir. As previously indicated, the leading 132 and trailing 134 surfaces of float feature 130 operate to keep the free end 124 of TDM 120 towards the surface of the accumulated toner. In this particular embodiment, the raking surfaces 126 may advantageously contact accumulated toner at an earlier time (as compared to the embodiment employing stop feature 140) to distribute the waste toner.

The previously described embodiments may also include an artificial interference mechanism, embodied in FIG. 7 as extension features 136 and/or 138. As previously described, drag imparted on the TDM 20, 120 by interference with accumulating toner in the container 28 may be detectable by the motor 22, motor drive circuit 26, motor control circuit 16, and logic circuit 18 shown in FIG. 3. More specifically, the logic circuit 18 may compare a motor control parameter that varies in relation to the imparted drag in an effort to maintain a constant agitating frequency or speed. Thus, the extension features 136, 138 may be advantageously impart extra drag on the TDM 20, 120 by creating interference between the moving TDM 20, 120 and the relatively stationary reservoir container 28.

In an exemplary embodiment, TDM extension feature 136 coupled at or near the free end of TDM 120 may contact a portion of the container 28 to create the artificial drag. TDM extension feature 136 may advantageously be implemented as a leaf spring or some other resilient device that effectively creates the additional drag without completely impeding the agitating motion of the TDM 120, TDM extension feature 136 is positioned to contact some portion of the container 28 or some extension thereof. For example, container extension feature 138 on the container 28 may represent a rib or other feature integral to the container housing 28. Alternatively, the extension feature 138 on the container 28 may represent a separate member attached to the inside of the container 28. Furthermore, while extension feature 138 is depicted in FIG. 7 as coupled to the roof 146 of the waste toner container 28, the TDM extension feature 136 may also be configured to contact some portion of extension of the side wall 144 or other interior surface of the container 28. It should also be understood that the induced artificial drag may be effectively achieved by adding an extension feature 136, 138 to one or both of the TDM 120 and the container 28, with one or both of the extension features 136, 138 being resilient.

Figure 8:
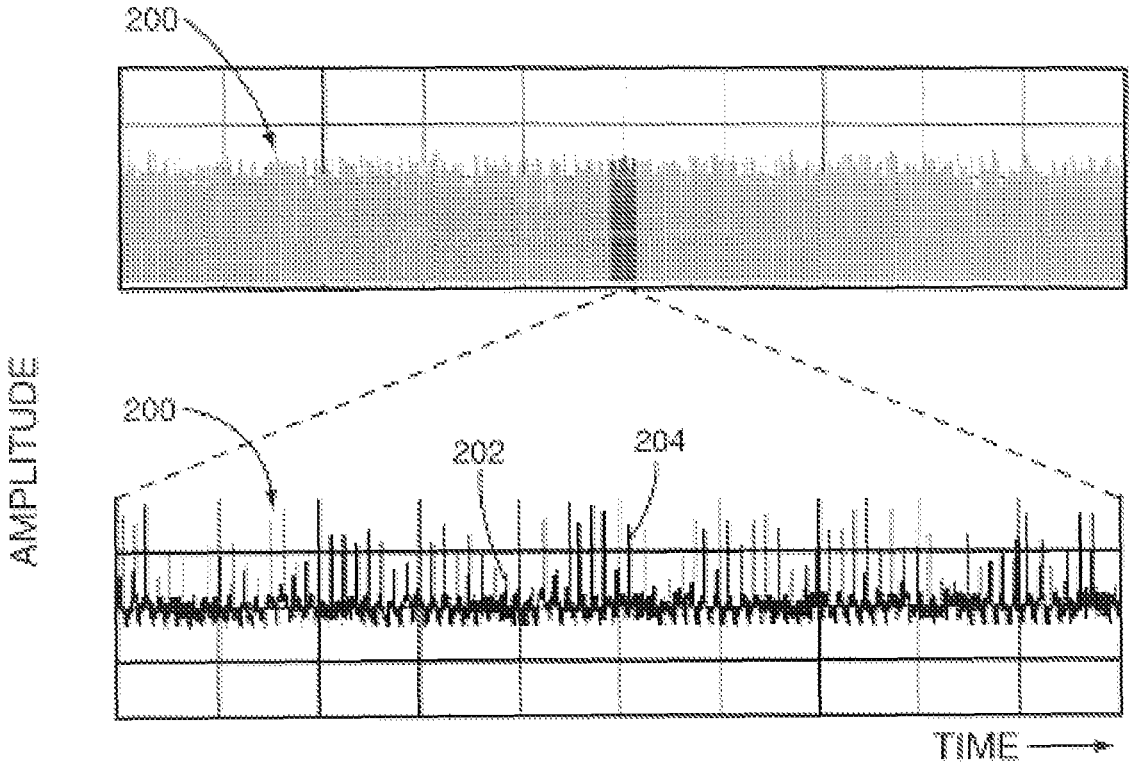
FIG. 8 is a graphical depiction of a motor control signal used in controlling operation of a shared, speed-controlled motor in an exemplary image forming apparatus.

Accordingly, embodiments disclosed herein describe a method of determining the load on a motor occurring at a specific frequency of interest. Generally, each of the components in the drive apparatus 24 includes a cyclic load having a characteristic signature. That is, as the motor 22 drives the first drive apparatus 30, the IFPM 32, the second drive apparatus 36, and the TDM 20, each of these cyclic mechanisms have a signature. That signature shows up in the load of the motor and thus in a monitored motor control parameter. As indicated, the motor control parameter may include a speed control signal, an error circuit signal, a PWM duty cycle, a current, or a voltage required to drive the motor. To illustrate this point, FIG. 8 shows the waveform 200 of the motor current driving IFPM 32 and TDM 20. Specifically, the upper graph in FIG. 8 shows that the waveform 200 varies over time. The lower graph in FIG. 8 is a detail representation of a portion of the upper graph and shows that the waveform 200 includes current spikes 202, 204 characterized by different amplitudes and frequencies.

The different components in the drive train leave their signature in the current waveform 200. For example, variations caused by the IFPM 32 may be caused by eccentricity in the IFPM 32. Similarly gears may contribute to the waveform 200 variations because of diametrical run-out or error in the teeth profiles. The TDM 20 may also contribute to load variations, particularly as toner levels in the waste toner container 28 increases. Notably, the load variation increases when the toner levels increase to the point where the extension features 136, 138 contact one another. However, since the TDM 20 is geared down as compared to the IFPM 32, the variations caused by the interference between the extension features 136, 138 may be less than variations caused by the first drive apparatus 30, the IFPM 32 or other components upstream of the TDM 20. For example, current spike 202 may represent a load variation caused by interference between the extension features 136, 138 while current spike 204 may represent a load variation caused by eccentricity in the IFPM 32.

Figure 9:
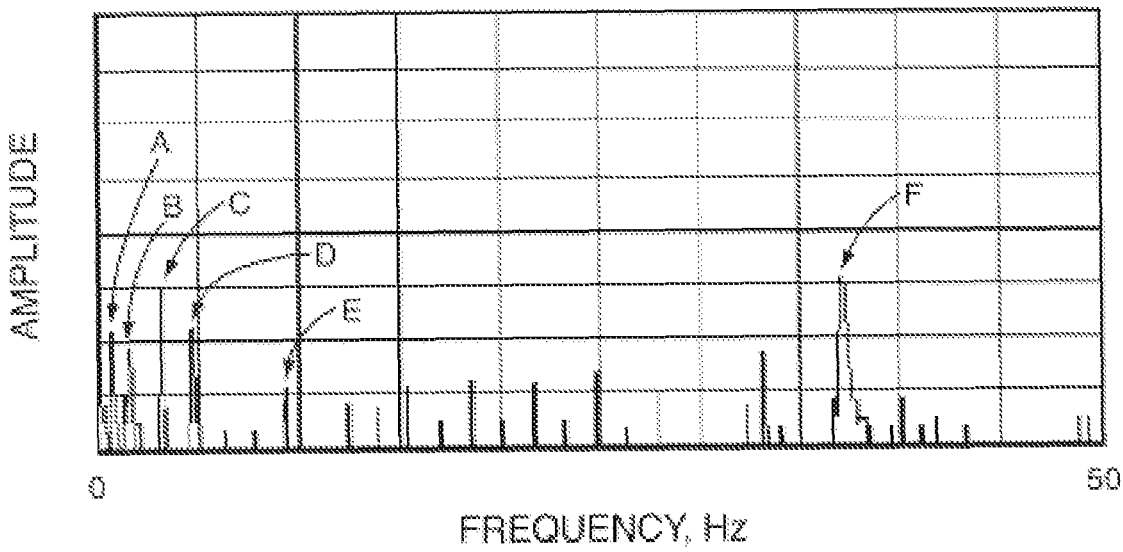
FIG. 9 is a graphical frequency domain representation of the motor control signal from FIG. 8.

The variation caused by the TDM 20 and/or the interference between the extension features 136, 138 may be extracted and identified through a spectral analysis of the monitored motor control parameter. Certain conventionally known data transforms such as Z-transforms, Laplace transforms, and Fourier transforms will re-express data or a function in terms of sinusoidal basis functions and therefore decompose a signal into its component frequencies and their amplitudes. For discrete data that is digitally sampled, the discrete Fourier transform (DFT) and the fast Fourier transform (FFT) offer convenient approximations of the Fourier transform that can be calculated in near-real time to analyze the data. Accordingly, the monitored motor control parameter shown in FIG. 8 may be transformed using a conventionally known frequency domain transform to obtain a spectral graph as shown in FIG. 9. In one embodiment, the transform is a DFT transform though others may be appropriate as will be understood by those skilled in the art.

Figure 10:
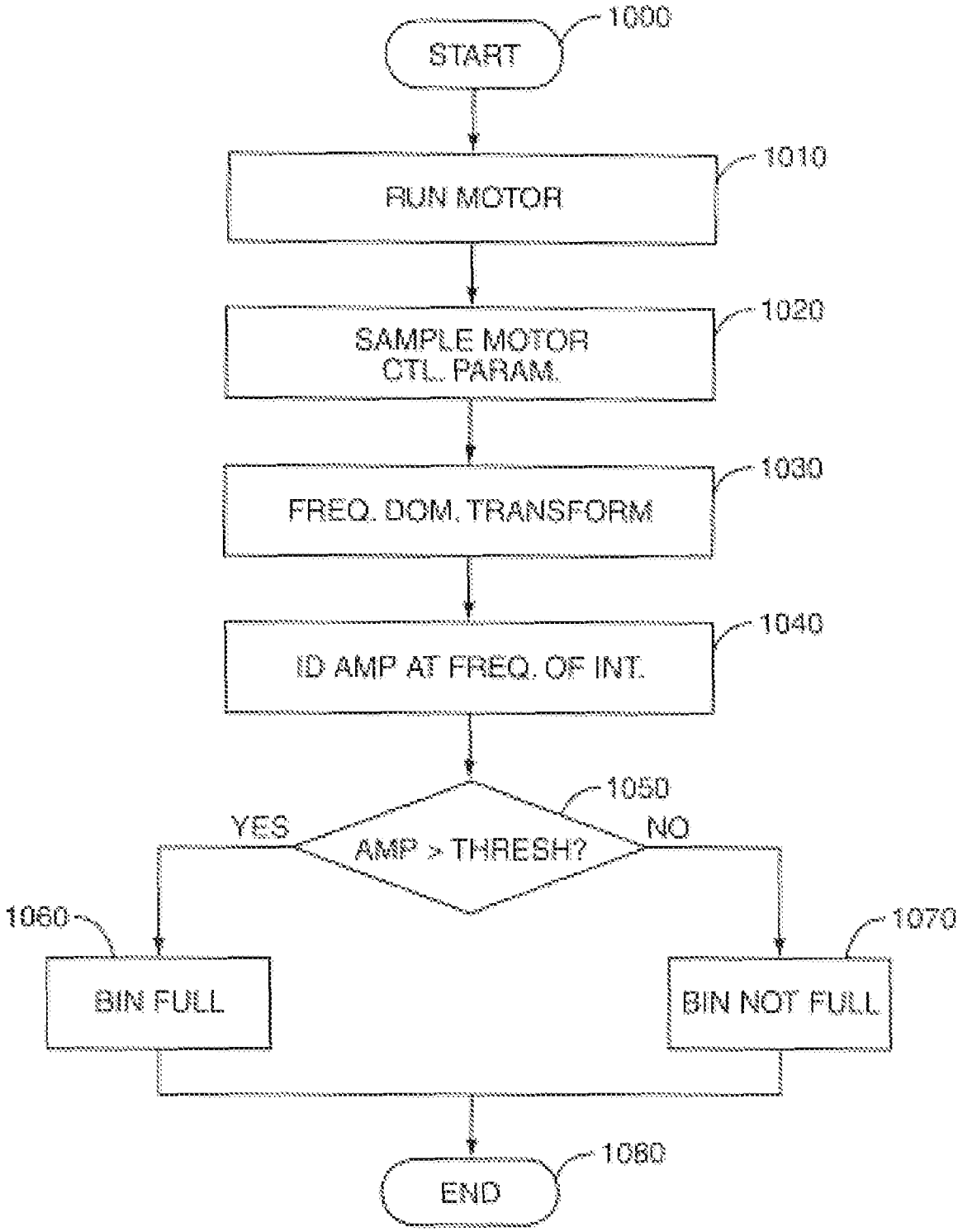
FIG. 10 is a process flow diagram outlining a method for detecting a full waste toner container according to one embodiment.

In FIG. 9, six different peaks are labeled A-F. The first five represent load variations placed on the motor 22 contributed by different components. For instance the peaks labeled B, C, D, and E may represent load variations contributed by various gears in the drive apparatus 24 and by the IFPM 32. The last of these peaks, labeled F, represents load variations contributed by the motor 22 itself. The first of these peaks, labeled A, represents load variations contributed by the TDM 20. At least two of the peaks C, D in FIG. 9 have an amplitude equal or greater than the amplitude of peak A. Consequently, an absolute amplitude threshold may not be sufficient to detect the load variations caused by interference between the extension features 136, 138. Nevertheless, it is possible to compare the amplitude at the known frequency of interest (e.g., at about 0.6 Hz for the TDM 20) to a threshold to determine when the waste toner container 28 is full. Accordingly, the process steps shown in FIG. 10 may be implemented to identify a full waste toner container 28.

The process begins at step 1000 where the motor 22 is accelerated to reach a steady state speed, where the motor 22 is run (step 1010) for a predetermined period of time to execute the desired check. While the motor 22 is running, the desired motor control parameter is sampled at step 1020. In one embodiment, the motor control parameter is an integrator value from a motor PI control loop associated with the error circuit 44 described above. In one embodiment, the motor 22 drive voltage or current may be sampled. In one embodiment, a digital representation of the motor 22 drive voltage or current may be sampled. Other motor control parameters may be used as well as described herein.

In step 1030, the sampled data is transformed according to a desired frequency domain transform. In one embodiment a DFT is used. In one embodiment, the DFT is calculated as the sampled data is collected, which may allow for minimal memory to be used. In one embodiment, the sampled data points are collected and stored in memory 48 and calculated via post-processing. At step 1040, the process identifies the amplitude of the transformed data at a particular frequency of interest. This amplitude is compared at step 1050 against a predetermined threshold. If the amplitude exceeds the predetermined threshold ("YES" path), the waste toner container 28 is classified as full (step 1060) and an appropriate interrupt and/or user warning can be generated. If the amplitude is less than the predetermined threshold ("NO" path), the waste toner container 28 is not classified as full (step 1070) and the image forming device 10 continues normal operation. At this point (step 1080), the process ends. This described process may be performed during a dedicated status check that is performed periodically to determine whether the waste toner container 28 is full. Alternatively, the process may be performed at start up, after a print job, while the motor is still running, or during normal printing operations.

It is generally known that the DFT of a discrete sequence x(I) with N samples is given by:

$$X(n) = \sum_{l=0}^{N-1} x(l) \cdot \exp\left[-j\frac{2\pi}{N}\ln\right], \text{ for } n = 0, 1, 2, \ldots, N-1 \tag{1}$$

where X(n) represents the frequency domain amplitude at a given frequency n. With this equation, calculation of the complete DFT requires about $N^2$ mathematical calculations, which can be processor intensive. It is also generally known that certain approximations, such as an FFT algorithm may reduce the number of mathematical calculations to about N log N mathematical calculations. Each approach may reveal a suitable solution to the present problem. That is, at step 1030, one may calculate the complete frequency-domain transform of the input string (in this case the motor control parameter sampled at discrete times I) and then identify an amplitude X(n) at the frequency of interest, n.

In one embodiment, the frequency domain conversion is implemented as a DFT routine that uses basic simple functions such as, for example, cosine, sine, square root, multiplication, and addition. For example, one known estimation of the DFT takes advantage of periodicity and superposition principals to calculate the transform using trigonometric sine and cosine coefficients. Generally, an estimation of a DFT of the same input string x(I) may be given by the following:

$$A(n) = \frac{2}{N}\sum_{l=1}^{N} x(l)\cdot\cos\left[\frac{2\pi}{N}\ln\right],\ \text{for } n = 0, 1, 2, \ldots, N/2 \tag{2}$$

$$B(n) = \frac{2}{N}\sum_{l=1}^{N} x(l)\cdot\sin\left[\frac{2\pi}{N}\ln\right],\ \text{for } n = 1, 2, 3, \ldots, N/2-1 \tag{3}$$

$$X(n) = \sqrt{A^2(n)+B^2(n)},\ \text{for } n = 0, 1, 2, \ldots, N/2 \tag{4}$$

where X(n) also represents the frequency domain amplitude at a given frequency n. This solution calculates amplitudes at multiple frequencies, n, including frequencies not at all related to the TDM 20. Calculation of the entire transform may unnecessarily consume processing time for the current problem. Consequently, it may be desirable to further simplify the frequency domain transform to calculate the amplitude X(n) at a particular frequency of interest. Therefore, the algorithm can be implemented as embedded software to run real-time in logic circuit 18, image processor 40, or speed controller 42. Accordingly, in one embodiment, the DFT routine is performed according to a specific implementation of equations 2-4 above and according to the process steps outlined in FIG. 11.

The exemplary DFT routine begins at step 1100 where three variables A, B, and I are initialized to zero. The DFT routine continues at step 1110 reading the motor control parameter PARAM as described above. During a first pass and during subsequent loops that run at a set time increment, variables A and B corresponding to equations 2 and 3 above are calculated (step 1120) according to:

$$A = A + PARAM\cdot\mathrm{COS}\left(\frac{2\Pi\cdot I\cdot NP}{N}\right) \tag{5}$$

$$B = B + PARAM\cdot\mathrm{SIN}\left(\frac{2\Pi\cdot I\cdot NP}{N}\right) \tag{6}$$

where the variables A, B, and I are running values that are used in determining the final output from the DFT routine and are updated during each calculation loop. The variable NP represents the number of periods of the desired frequency to capture. The variable N represents the total number of cycles through which the DFT routine runs. The variable N is determined in part by the desired frequency of interest, the desired number of periods to monitor at the desired frequency of interest, and the clock speed or sampling speed. To provide an example, the variable N may be calculated according to:

$$N = \mathrm{floor}\left(\frac{NP}{DF*\Delta t}\right) \tag{7}$$

where NP is the number of periods as described above, DF is the desired frequency of interest, and Δt is the time increment representing the clock period, sampling period, or other relevant time increment over which the DFT routine is run. The "floor" operation yields an integer value. At each loop, the integer I is incremented. The routine continues until the integer I exceeds variable N (step 1130). Finally, at step 1140, the DFT routine ends by outputting the desired amplitude AMP according to the equation:

$$AMP = \sqrt{\left(\frac{2\cdot A}{N}\right)^2 + \left(\frac{2\cdot B}{N}\right)^2} \tag{8}$$

As described, the DFT routine collects an integer number of periods NP at the frequency of interest. The greater the number of periods NP collected, the more accurate the output. It is also advantageous to choose the number of periods NP to collect an integer number of cycles of other nearby frequencies (or as close as possible) so as to monitor a predetermined range of frequencies about the frequency of interest. As with many numerical methods, with the number of periods NP less than infinity and the time increment Δt equal to zero, this equations used in the exemplary DFT routine are an approximation. However, having the number of periods NP include an integer number of nearby frequencies allows the routine to more accurately identify the frequency of interest.

Figure 11:
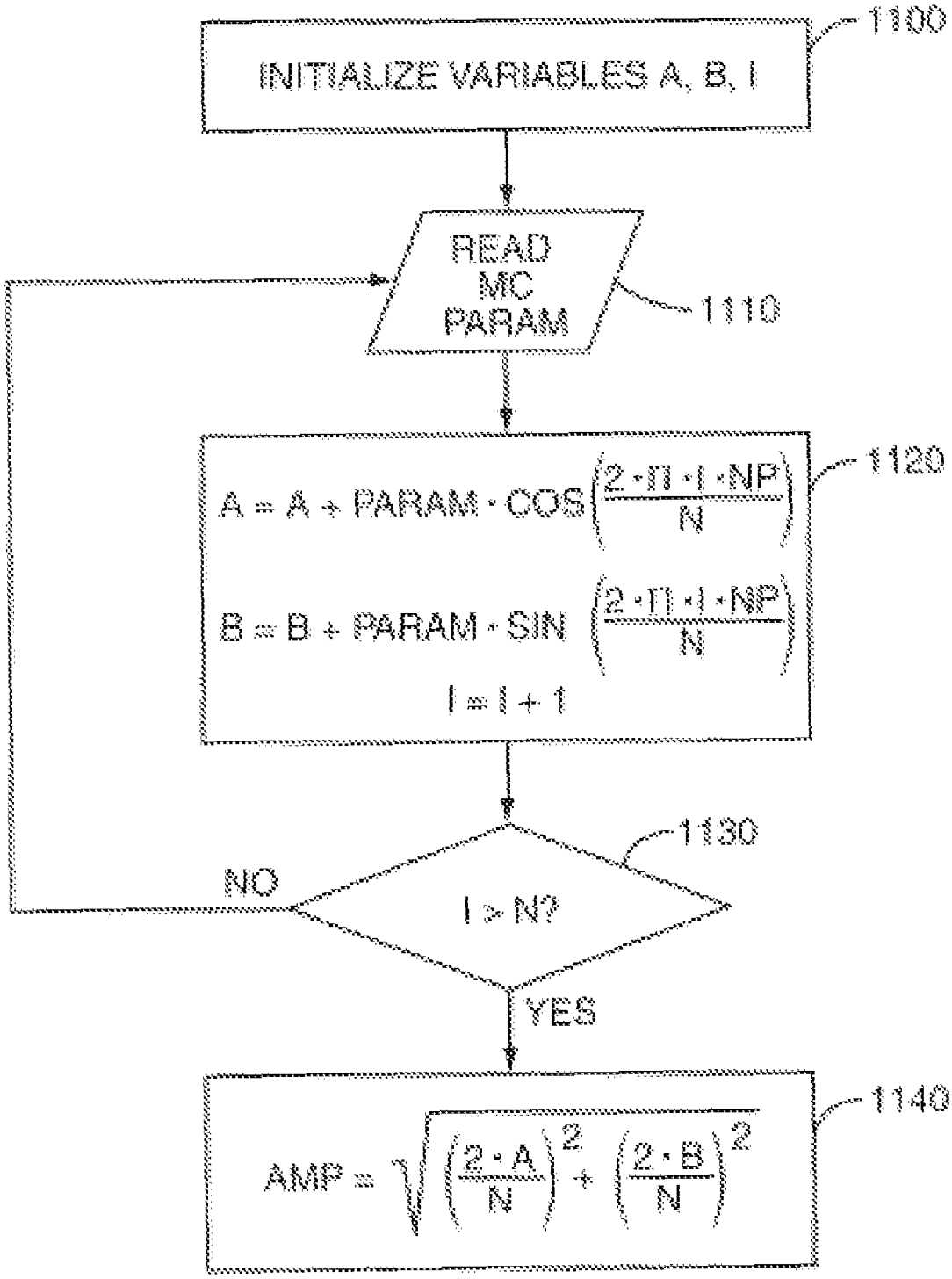
FIG. 11 is a process flow diagram outlining a method for calculating a Discrete Fourier Transform approximation used in detecting a full waste toner container according to one embodiment.

For the sake of completeness, an exemplary DFT routine according to FIG. 11 may use values for the desired frequency of 0.6249 Hz, a motor speed of 2223 RPM, a time increment Δt of 0.001 seconds, the number of periods monitored NP of 7, to provide a value of 11202 for the variable N. Using these exemplary values, a predetermined threshold of 30 may be used as an amplitude at the desired frequency of interest that must be exceeded to indicate a full waste toner container 28.

The present invention may be carried out in other specific ways than those herein set forth without departing from the scope and essential characteristics of the invention. For instance, the embodiments described have been depicted in use with a TDM 20, 120 that is agitated in a reciprocating manner using an eccentric, rotary gear 76. The TDM 20, 120 may also be reciprocated using a linearly actuated solenoid or other motion translating device. In another embodiment, the TDM 20, 120 is positioned within an incoming toner reservoir (i.e., unused toner). The algorithm to detect motor load variations at a specific frequency could be used in various other ways. Accordingly, the present invention is not intended to only include application of the waste toner box, but to include the use of this technique for detecting any important load variation frequency in a machine. For example, the technique could be used to detect problems with gears, cartridges, augers, rollers, and associated errors that induce a cyclical load. The technique could be used beyond the scope of a DC motor, such as for detecting key frequencies of sensor voltages, cartridge transfer currents or any signal containing frequencies that can be sampled. Of course, those skilled in the art will recognize other potential opportunities to gain additional advantages, and it should be understood that the present invention is not limited by the foregoing discussion, or by the accompanying illustrations. Indeed, the present invention is limited only by the following claims and the reasonable equivalents thereof.

What is claimed is:

1. An image forming device comprising:

a member movably positioned within a waste toner container, the member causing an interference with the waste toner container when the amount of toner in the waste toner container reaches a predetermined quantity;

an image forming process member;

a shared motor operatively connected to the member to move the member in a reciprocating manner, the shared motor further moving the image forming process member in a cyclic manner;

a motor control circuit to control the shared motor based at least partly upon a motor control signal;

a logic circuit to detect an accumulation of waste toner based on monitoring a predetermined frequency of interest of a frequency domain transform of the motor control signal, the frequency of interest associated with the shared motor moving the member against the interference.

2. The image forming device of claim 1 wherein the image forming process member is a roller.

3. The image forming device of claim 2 wherein the roller is a registration roller.

4. The image forming device of claim 1 wherein the logic circuit detects the interference to detect the accumulation of waste toner at or above the predetermined quantity.

5. The image forming device of claim 1 wherein the logic circuit detects the interference by determining when the amplitude of the motor control signal at the frequency of interest exceeds a predetermined threshold.

6. The image forming device of claim 1 wherein the member and the image forming process member are driven by the shared motor at different respective gear ratios.

7. The image forming device of claim 6 wherein the frequency of interest is derived from the gear ratio between the shared motor and the member.

8. The image forming device of claim 1 wherein the motor control signal is a motor drive signal.

9. The image forming device of claim 1 wherein the motor control signal is an error circuit signal.

10. An image forming device comprising:

a first member movably positioned within the image forming device;

a second member movably positioned within the image forming device;

a shared motor operatively connected to the first and second members to move the first and second members in a cyclic manner;

a motor control circuit to control the shared motor based at least partly upon a motor control signal;

a logic circuit to detect an error associated with the first member based on monitoring, in a frequency domain, a predetermined frequency of interest of the motor control signal, the frequency of interest associated with the shared motor driving the first member against a cyclic load.

11. The image forming device of claim 10 wherein the first member is a toner distributing member positioned within a waste toner container.

12. The image forming device of claim 10 wherein the second member is an image forming process member.

13. The image forming device of claim 10 wherein the cyclic load is an interference between the moving first member and a relatively stationary portion of the image forming device.

14. The image forming device of claim 10 wherein the error is a waste toner accumulation error.

15. The image forming device of claim 10 wherein the motor control signal is a motor drive signal.

16. The image forming device of claim 10 wherein the motor control signal is an error circuit signal.

17. An image forming device comprising:

a member movably positioned within a waste toner container, the member causing an interference with the container when the amount of toner in the reservoir reaches a predetermined quantity;

a motor operatively connected to the member to move the member in a reciprocating manner;

a motor control circuit to control the motor based at least partly upon a motor control signal;

a logic circuit to detect accumulation of waste toner based on monitoring a predetermined frequency of interest of a frequency domain transform of the motor control signal, the frequency of interest associated with the motor driving the toner distributing member against the interference.

18. The image forming device of claim 17 wherein the frequency domain transform is a Fourier transform.

19. The image forming device of claim 17 wherein the frequency domain transform is an approximation of a Discrete Fourier Transform.

20. The image forming device of claim 17 wherein the frequency of interest is derived from a gear ratio between the motor and the member.

21. The image forming device of claim 17 wherein the motor control signal is a motor drive signal.

22. The image forming device of claim 17 wherein the motor control signal is an error circuit signal.

23. A method of operation in an image forming apparatus that includes a waste toner system, the method comprising:

using a speed-controlled motor to drive a toner distributing member that distributes waste toner collected in a waste toner container;

operating the speed-controlled motor in a feedback loop that uses a motor control signal; and detecting an accumulation of waste toner based on monitoring a predetermined frequency of interest of a frequency domain transform of the motor control signal that varies as needed to substantially maintain a desired motor speed while driving the toner distributing member.

24. The method of claim 23 wherein the frequency of interest is derived from a gear ratio between the speed controlled motor and the toner distributing member.

25. The method of claim 23 wherein the toner distributing member is a reciprocating toner rake, and wherein detecting the accumulation of waste toner comprises detecting when an amplitude of the motor control signal at the predetermined frequency of interest exceeds a predetermined threshold.

26. The method of claim 23 wherein the toner distributing member is a reciprocating toner rake, and wherein the frequency domain transform is a discrete Fourier transform and detecting the accumulation of waste toner comprises detecting when an amplitude of the discrete Fourier transform of the motor control signal at the predetermined frequency of interest exceeds a predetermined threshold.

27. The method of claim 23 wherein the motor control signal is a motor drive signal.

28. The method of claim 23 wherein the motor control signal is an error circuit signal.

29. The method of claim 23 further comprising driving an image forming process member using the speed-controlled motor.

30. The method of claim 29 further comprising driving the toner distributing member and the image forming process member at different gear ratios and determining the frequency of interest based at least partly on the gear ratio between the toner distributing member and the speed-controlled motor.

31. A method of operation in an image forming apparatus that includes a waste toner system, the method comprising:

using a speed-controlled motor to drive a toner distributing member that distributes waste toner collected in a waste toner container;

operating the speed-controlled motor in a feed back loop that uses a motor control signal;

causing an interference between the toner distributing member and the waste toner container when the accumulation of waste toner reaches a predetermined value;

calculating a frequency domain transform of the motor control signal; and detecting the interference by determining when an amplitude of the frequency domain transform at a predetermined frequency of interest exceeds a predetermined threshold.

32. The method of claim 31 wherein the frequency domain transform is a Fourier transform.

33. The method of claim 31 wherein the frequency domain transform is an approximation of a Discrete Fourier Transform.

34. The method of claim 31 wherein the motor control signal is a motor drive signal.

35. The method of claim 31 wherein the motor control signal is an error circuit signal.

36. The method of claim 3 further comprising driving an image forming process member using the speed-controlled motor.

37. The method of claim 36 further comprising driving the toner distributing member and the image forming process member at different gear ratios and determining the frequency of interest based at least partly on the gear ratio between the toner distributing member and the speed-controlled motor.

* * * * *